United States Patent [19]

Yuehui et al.

[11] Patent Number: 4,756,538

[45] Date of Patent: Jul. 12, 1988

[54] DEVICE FOR CLAMPING DRILL PIPE AND THE LIKE IN MOUSE HOLE PIPE

[75] Inventors: Chen Yuehui; Jin Weiguo, both of Tienjing, China

[73] Assignee: The Science and Technic Department of Dagang Petroleum Administration, Tianjin, China

[21] Appl. No.: 843,706

[22] Filed: Mar. 25, 1986

[30] Foreign Application Priority Data

Apr. 1, 1985 [CN] China ..... 85200440

[51] Int. Cl.[4] ..... B25B 5/08; E21B 19/16

[52] U.S. Cl. ..... 279/28; 81/57.34; 173/164; 279/33; 279/38

[58] Field of Search ..... 81/57.11, 57.16, 57.34, 81/57.33, 57.2, 57.21; 173/163, 164; 166/77.5; 175/85; 279/28, 38, 33, 71, 72

[56] References Cited

U.S. PATENT DOCUMENTS

| | | | |
|---|---|---|---|
| 3,689,060 | 9/1972 | Hensley, Jr. | 279/33 X |
| 3,760,469 | 9/1973 | Brown | 279/4 X |
| 4,147,215 | 4/1979 | Hodge et al. | 166/315 |
| 4,170,908 | 10/1979 | Peveto et al. | 81/57.11 |
| 4,200,010 | 4/1980 | Hewitt | 81/57.16 |
| 4,221,269 | 9/1980 | Hudson | 173/163 |
| 4,402,239 | 9/1983 | Mooney | 81/57.34 |
| 4,458,562 | 7/1984 | Jackson | 81/57.34 |
| 4,576,254 | 3/1986 | Cox | 279/4 X |

FOREIGN PATENT DOCUMENTS

| | | | |
|---|---|---|---|
| 609862 | 6/1978 | U.S.S.R. | 173/164 |
| 374004 | 8/1982 | U.S.S.R. | 81/57.21 |

*Primary Examiner*—Z. R. Bilinsky

*Attorney, Agent, or Firm*—Jules E. Goldberg

[57] ABSTRACT

The invention relates to a clamping device used for making up or breaking apart joints of drill pipe, drill collars and the like in mouse hole pipe during oil drilling operation. A clamping means of the device firstly clamps the drill pipe therebetween during its moving down and centripetally simultaneously by the self-weight of drill pipe to be clamped, then tightly clamps the drill pipe with a force generated by rollers' moving inwardly to the center of the device along the concavity of the turning plate with the rotation of a kelly. It can be used instead of a back tong when making-up joint in mouse hole pipe with a tong.

7 Claims, 3 Drawing Sheets

DEVICE FOR CLAMPING DRILL PIPE AND THE LIKE IN MOUSE HOLE PIPE

BACKGROUND OF THE INVENTION

1. Field of the Invention

The invention relates to a device for making-up or breaking-out joints of drill pipe, drill collars and the like in mouse hole pipe quickly and easily.

2. Description of the Prior Art

One of the existing powerless clamping device for drill pipe, drill collars and like in the mouse-hole pipe is of a turning plate type which is manually operated and the clamping is effected by turning an eccentric jaw plate. This type is suitable for making-up joints with a small torque, but if the making-up torque is large, the clamping device will be damaged. Another one is spiral guide downward clamping device which occupies a larger space and is complicated in structure. The two device mentioned above can only work in one rotational direction. This is the weakness of these kinds of clamping devices.

SUMMARY OF THE INVENTION

The main object of this invention is to provide a kind of powerless clamping device for drill pipe, drill collars and the like in the mouse-hole pipe. The clamping is effected automatically by the self-weight of drill pipe to be clamped and the clamping force is increased by the making-up torque or breaking-out torque. Upon lifting the drilling pipe the clamping force will be eliminated automatically.

In order to achieve the main object, this invention provides a housing and clamping mechanism capable of moving a limited axial distance within the housing. The housing is installed on a fixed mouse hole pipe flange and is movable axial but not rotatable with regard to the mouse-hole pipe flange. In the housing there is a portion of cylindrical bore, above which are located a pair of radial ear-like portions protruding outwardly, wherein a pair of symmetrical inner end surfaces extending axially and inclining inwardly from the opening. On a floating body placed in the housing, an upward force is exerted by a compression spring. A pair of turning plate mechanisms pivotally mounted to lugs on both sides of the floating body are movable radially along the lateral pin holes in the lugs and turnable outwardly about the pin axis. Each turning plate mechanism has a jaw plate which has a toothed inner radial surface and can move radially and circumferentially within a limited range. On the outer radial surface of the jaw plate there is a portion of inwardly concave surface which facing a concave surface of the turning plate concentric with the said pipe. Between the two curved surfaces is situated a roller which can roll freely. The outer contour of the turning plate always contacts the inclined surface in the housing. In addition, there is a hook mounted on the turning plate to catch the pipe joint from below. When putting drill pipe into the clamping device the protruded circumference of pipe joint is rested on the hook, making the floating body and turning plate mechanism both move downwardly together within the housing. By the action of inclined planes on both sides of the housing the turning plate mechanism moves radially inwardly while it moves downwardly, then the jaw plates grip the drill pipe. During making-up or breaking-out operation, the jaw plates are brought into a circular motion thereby forcing the rollers between jaws and turning plates to go inwardly along the curved surfaces thereby increasing the gripping force of jaw plates to the drill pipe. When lifting the drill pipe, the housing and clamping mechanism will move up together at the beginning. After moving up a short distance, a releasing device stops the housing and generates a shock to release friction between the inclined inner surfaces of the housing and the turning plates. Under the action of spring force the floating body and the turning plate mechanism will be restored to their original positions, thus clamping force is removed. The lower joint of the upwardly moving drill pipe will turn the turning plate mechanism over and will be pulled out of the clamping mechanism.

DESCRIPTION OF THE PREFERRED EMBODIMENT

Figure 1:
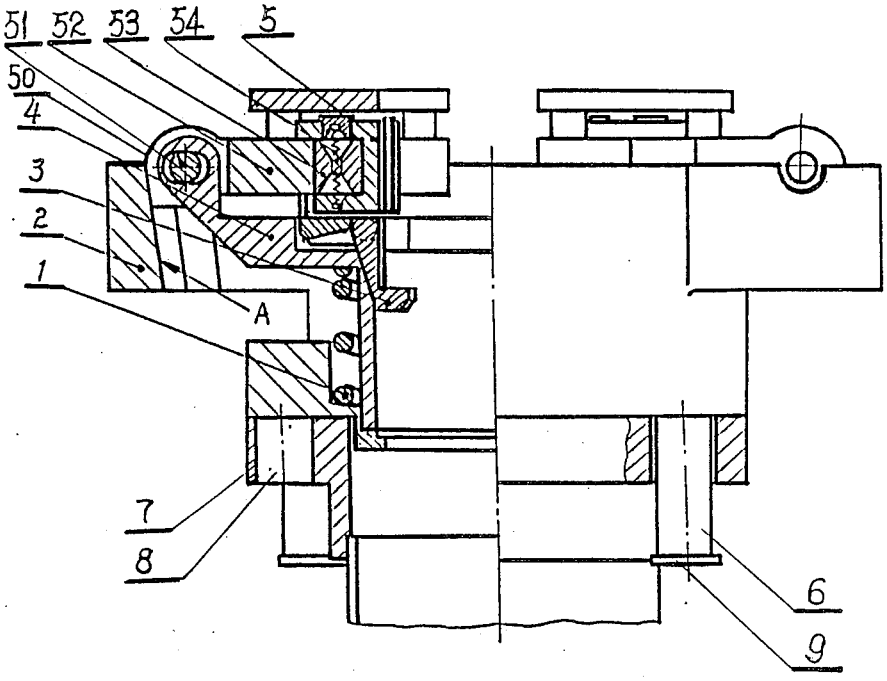
FIG. 1 is a front partial sectional view of the preferred embodiment of the invention.
Figure 2:
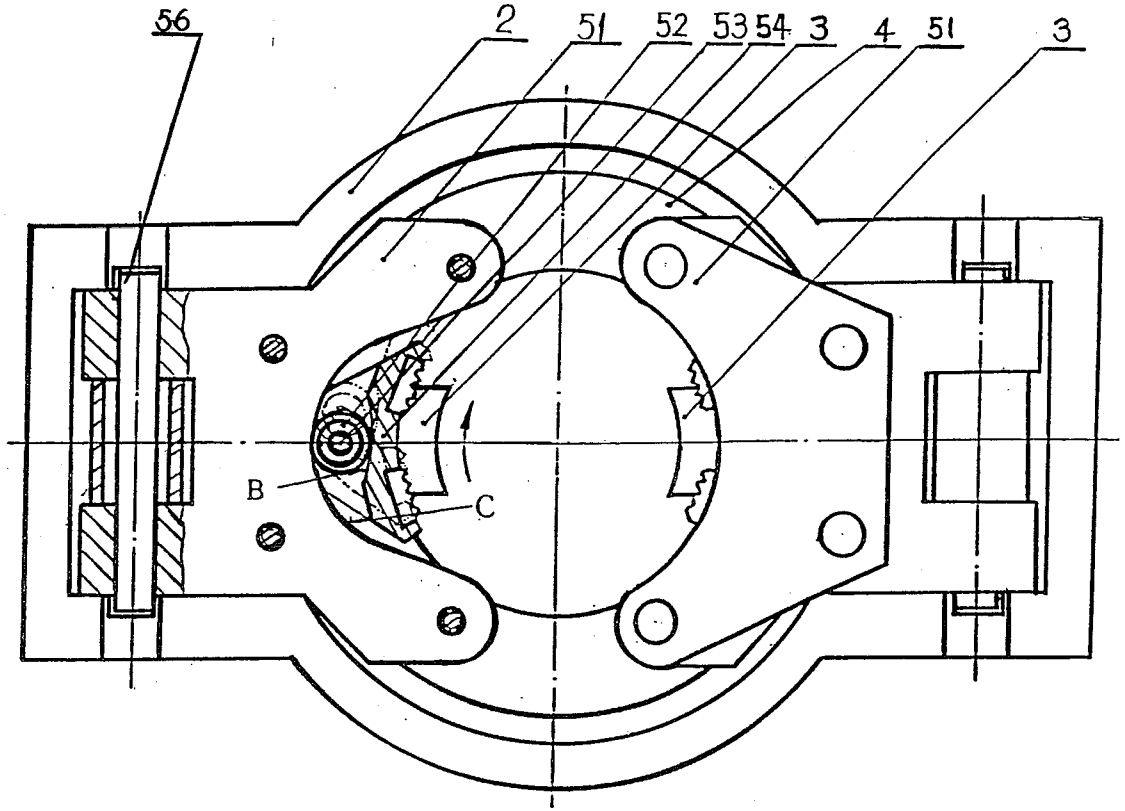
FIG. 2 is a top view of FIG. 1.

Refering now to FIGS. 1 and 2, a preferred embodiment of the present invention is shown. The upper end of mouse-hole pipe has a flange (7) with holes (8) equally spaced in circumference. A housing (2) is situated concentrically on flange (7). Pins (6) passing through holes (8) in flange (7) from bottom to top are attached to the lower end of the housing (2). Each pin has a portion (9) at lower end thereof with bigger diameter than that of hole (8), therefore allowing the housing (2) to move axially within a limited range relatively to flange (7) but preventing it from rotating relatively. The housing has stepped bore therein. The upper portion of which having a bigger diameter symmetrically and laterally extends to opposite sides forming a rectangular chamber. The opposite inner end faces (A) of the chamber extend longitudinally to the bore axis and are inclined upwardly with an included angle with the bore axis less than 15 degrees. Clamping mechanism (5) including floating body (4) and turning plate mechanism (50) is placed in housing (2) and is movable axially within a limited range therein. Floating body (4), placed in the chamber of housing (2), is a stepped sleeve with two symmetrical protruding lugs at the upper end. A compression spring (1) jackets the floating body with one end thereof abutting against the shoulder at the middle of floating body and the other end thereof against the lower inner end face of the housing. The lower end of floating body has a radially protruding stopper to prevent floating body (4) from moving out of the housing (2). A pair of turning plate mechanisms 50 is pivotally mounted respectively to the protruding lugs on opposite sides of floating body (4), so that they can be turned to a open or a close position. Since the pivotal holes in the protruding lugs of floating body (4) are lateral slotted holes, the turning plate mechanism (50) not only can swing relatively to floating body (4) but also can move radially a limited distance in respect to the floating body. Each turning plate mechanism comprises turning plate (51), jaw plate (54), roller (52) and hook (3). Each turning plate (51) is a platelike component, in back end of which provided with a pin hole and a notch in the middle of back end for receiving the protruding lug of floating body. When turning plate and floating body are connected together by pin (56), the rear end of turning plate is always higher than the rear end of the protruding lug and consequently will keep in touch with the inclined surface (A) of the housing (2). Both ends of pin (56) which joints turning plate (51) and floating body (4) lie loosely in the inclined slots on two side walls of housing (2) paralled to the inclined inner wall (A). The front side of each turning plate has a notch for receiving jaw plate (54). Said jaw plate being floatly mounted in the notch. There is a concave cylindrical surface (C) in the middle of the notch. Jaw plate is flexibly mounted within the notch. The front side of jaw plate has a toothed approximately V-Shaped grip portion. The rear side of jaw plate has a length of concave cylindrical surface (B) facing with the concave cylindrical surface (C) in the turning plate. A roller (52) can be just placed in between the two cylindrical surfaces. The half angles at the centre of the concave cylindrical surfaces mentioned above should not be less than 14° and the radii should be larger than the radius of roller (52). Roller (52) is pivotally mounted to the jaw plate by a pin shaft made of a cylindrical spring. On the lower side of each turning plate is provided an oscillatably swing hook (3) which can hook up the flange of pipe joint.

Figure 3:
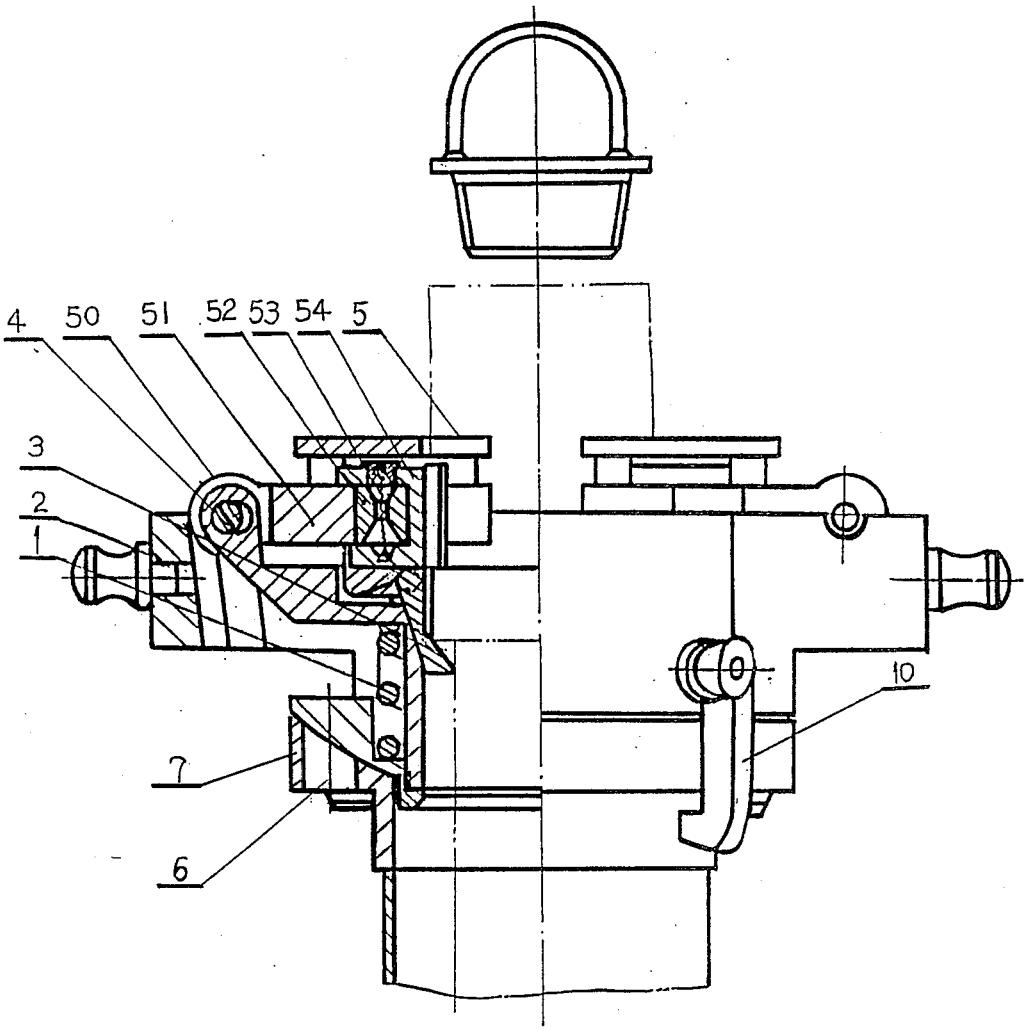
FIG. 3 is a schematic drawing of another embodiment of the invention.

After the drill pipe is lowered into the mouse-hole, pipe joint seat is supported by hooks (3). Turning Plate mechanisms (50) and floating body (4) will move downwardly together due to the self-weight of pipe. By the action of inclined inner wall (A) in housing (2), turning plate mechanisms (50) move centripetally to grip drill pipe. Under the action of torque force induced by making-up or breaking-out operation, rollers (52) move inwardly as it rolls on surfaces (B) and (C) thereby making jaw plates to further grip the drill pipe. After the completion of the operation, during lifting of the drill pipe a certain amount of shock force is produced by the collision of the portions having larger diameter (9) of pins (6) with flange (7) to disengage the inner inclined surfaces (A) of housing (2) from turning plates, so as to allow turning plate mechanisms (50) and floating body (4) to move upward together under the action of spring (1). Because of the interaction between pins (56) and the inclined slots on opposite side walls of housing (2), the clamping mechanism will return to its original position. Upon drill pipe being lifted out of the clamping device, the lower joint step of the drill pipe turns the turning plate mechanisms (50) to open and hooks (3) retract in preparation for putting in next drill pipe. FIG. 3 shows another embodiment of the invention. Its principal design is as the same as the previous one, therefore same reference signs are used. One improvement is about the releasing mechanism. In present embodiment the pins (6) are shorter than those used in the first embodiment and there is no shoulder at its outer end, hence it only acts for locating in installation, axial guidance and rotation prevention. On the outer side surface of housing is attached a pair of releasing hooks (10) which can swing. The end of hook (10) is at a distance from the lower end surface of flange (7) when the hooks are at vertical position. When the making-up or breaking-out operation is completed and the drill pipe is being lifted, releasing hooks (10) knock the lower end surface of flange (7) whereby bringing about a releasing action just equifinal the action of the shoulders of pins (6) in the previous embodiment. In addition, the contact surfaces of the housing and the flange are manufactured into matchable spheres respectively for ease of installation.

We claim:

1. A device for clamping drill pipe and the like in mouse hole pipe comprising:

a flange vertically fixed on the upper end of mouse hole pipe with through holes equally spaced around the circumference;

a housing coaxially situated on an end surface of said flange, said housing being movable axially with respect to said flange within a limited distance and unrotatable with respect to said flange;

a clamping mechanism axially movable within a limited distance within said housing, when moving axially forced by the weight of the drill pipe being clamped, a part of said mechanism moving radially simultaneously so as to preliminarily grip said drill pipe, when screwing or unscrewing said drill pipe with an individual tool, the clamping members of said mechanism having a small radial displacement toward said pipe, thereby to provide a further clamp force corresponding to the torque of said screwing or unscrewing operation, when lifted axially together with said drill pipe against their weight, said part of said mechanism moving radially simultaneously in opposite directions to release said pipe;

a releasing mechanism forcing said clamping mechanism to release said drill pipe;

said housing having an axially arranged stepped circular bore, the upper portion thereof having a diameter symmetrically and laterally extending in opposite directions to form a rectangular chamber wherein the inner end surfaces of said chamber are inclined planes extending axially from the open end of the housing and the two inner lateral side walls having inclined slots near and parallel to said inclined planes, and having cylindrical pins attached to said lower end face of said housing and capable of loosely fitting into the through holes of said flange.

2. The clamping device as defined in claim 1 wherein each of the inclined planes on the housing makes an angle less than 15 degrees with the axis of the housing.

3. The clamping device as defined in claim 1 wherein the movable clamping mechanism comprises a pair of turning plate mechanisms and a floating body swingably connected together, said turning plate mechanism being movable radially within a limited distance with regard to said floating body, said floating body being a stepped sleeve with two symmetrical protruding lugs at its upper portion having a larger diameter than the lower, non-protruding portion, a compression spring jacketed onto the smaller diameter portion of said floating body, with its one end abutting against the lug shoulder in the middle of said floating body and the other end against the inner face of the lower end of said housing, the outer end of the smaller diameter portion of the floating body extending from said housing and having a radially protruding stopper to prevent the floating body from escaping from the interior of the housing, and pin holes provided on said lugs which extend laterally and perpendicular to the floating body axis.

4. The clamping device as defined in claim 3 wherein each said turning plate mechanism comprises a turning plate, a jaw plate, a roller and a hook, said turning plate being a plate-shaped component and having at the middle of its rear side, a notch matching the width of said lugs, when connected to said floating body with a pin said rear end of said turning plate being always higher than said lug, protruding portions of opposite ends of said pin being received by said inclined slots on side walls of said housing, the middle portion of a notch on the front side of said turning plate being a concave cylindrical surface substantially perpendicular to said plate, said jaw plate placed floatingly in said notch having, on its rear end, a portion of concave cylindrical surface facing with and parallel to said concave cylindrical surface on said turning plate, and, on its front end, a length of toothed face in an approximate V-shape, a roller supported by an elastic pin shaft on said jaw plate being placed in the space between said concave cylindrical surface on said jaw plate and concave cylindrical surface on said turning plate, a swing hook being vertically mounted to the bottom of said turning plate.

5. The clamping device as defined in claim 4 wherein the radius of said concave cylindrical surface on said turning plate is larger than that of the roller and its half angle at the center is more than 14 degrees.

6. The clamping device as defined in claim 4 wherein the radius of said concave cylindrical surface on said jaw plate is larger than that of the roller and its half angle at the center is more than 14 degrees.

7. The clamping device as defined in claim 4 wherein said elastic pin shaft supporting said roller being a cylindrical spring.

* * * * *